US006677096B2

(12) United States Patent
Tachi et al.

(10) Patent No.: US 6,677,096 B2
(45) Date of Patent: Jan. 13, 2004

(54) POSITIVELY CHARGEABLE TONER FOR TWO-COMPONENT DEVELOPMENT

(75) Inventors: Hidenori Tachi, Wakayama (JP); Shinji Moriyama, Wakayama (JP); Yoshihiro Fukushima, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/131,028

(22) Filed: Apr. 25, 2002

(65) Prior Publication Data

US 2003/0022087 A1 Jan. 30, 2003

(30) Foreign Application Priority Data

Apr. 27, 2001 (JP) ..... 2001-133609

(51) Int. Cl.[7] ..... G03G 9/08

(52) U.S. Cl. ..... 430/108.7; 430/111.31; 430/137.1

(58) Field of Search ..... 430/108.7, 108.2, 430/108.3, 109.4, 111.31, 137.1

(56) References Cited

U.S. PATENT DOCUMENTS 5,900,343 A 5/1999 Ochiai et al.
6,087,059 A * 7/2000 Duggan et al. ..... 430/111
6,117,607 A * 9/2000 Shimizu et al. ..... 430/110
6,187,489 B1 2/2001 Oishi et al.
6,187,490 B1 2/2001 Taya et al.

FOREIGN PATENT DOCUMENTS

JP 59104663 A 6/1984
JP 63139366 A 6/1988
JP 63-55701 11/1988
JP 10104884 A 4/1998
JP 2000267357 9/2000
JP 2000330342 A 11/2000

* cited by examiner

*Primary Examiner*—John Goodrow
(74) *Attorney, Agent, or Firm*—Birch, Stewart, Kolasch & Birch, LLP

(57) ABSTRACT

A positively chargeable toner for two-component development comprising a resin binder; a colorant; a releasing agent comprising a wax having a melting point of 50° to 120° C.; and an external additive comprising a positively chargeable silica, the positively chargeable silica having an absolute deviation of an error of 0.1 or less, against an approximate straight line showing an adhesion state of silicon atoms to carbon atoms, and a free ratio of 5% or less, wherein the positively chargeable toner is usable together with a ferrite carrier having a saturation magnetization of from 40 to 100 $Am^2/kg$. This positively chargeable toner is used for development of an electrostatic latent image formed in electrophotography, electrostatic recording method, electrostatic printing method, or the like.

16 Claims, 1 Drawing Sheet

POSITIVELY CHARGEABLE TONER FOR TWO-COMPONENT DEVELOPMENT

BACKGROUND OF THE INVENTION

1. Field of the Invention

The present invention relates to a positively chargeable toner for two-component development which is used for development of an electrostatic latent image formed in electrophotography, electrostatic recording method, electrostatic printing method, or the like, a positively chargeable two-component developer comprising the positively chargeable toner, and a process for preparing the positively chargeable toner.

2. Discussion of the Related Art

In recent years, with the development of on-demand printing, there has been required a positively chargeable two-component developer giving high-quality image and high speed. Especially, in order to meet the requirement of high-quality image, a ferrite carrier having a low saturation magnetization as compared to that of iron powder or magnetite has been used (Japanese Patent Laid-Open Nos. Sho 59-104663, 2000-330342, Hei 10-104884 and the like). However, when the saturation magnetization is lowered, magnetic brush is weakened, so that an ability of scraping off a toner adhered to a photoconductor is weakened, thereby causing filming.

Especially, when an external additive such as silica or titanium oxide is added from the viewpoints of securing chargeability and fluidity, the external additive is freed when stirring during triboelectric charging, or an external additive originally freed is adhered to a photoconductor, so that the external additive acts as a core to form a coating film for a toner, thereby causing filming of a toner on the photoconductor.

Japanese Examined Patent Publication No. Sho 63-55701 discloses a toner having a small change in fluidity even after running by mixing a toner in which a silica is embedded in a toner surface, with a silica not embedded in a toner surface. However, in a long-term and high-speed printing, a stress against a toner or a photoconductor is increased, so that the silica on a photoconductor acts as a core, whereby filming is likely to be caused. Especially, in the positively chargeable two-component developer, this tendency is remarkable, because a positively chargeable silica is likely to be transferred to a carrier.

Therefore, there have been proposed to reduce filming by completely removing free, fine inorganic particles which are not adhered to a toner in Japanese Patent Laid-Open No. Sho 63-139366, or by using titanium oxide having a specified value in the correlation coefficient of an approximation curve showing the adhesion state in Japanese Patent Laid-Open No. 2000-267357. However, in the former method, when printing is run for a long term, the fluidity of the toner is lowered because the fine inorganic particles adhered to the toner are embedded in the toner, so that there arise some problems in printed images such as decrease in the image density and background fogging. In the latter method, since titanium oxide is very hard, there is a risk of damaging a photoconductor.

An object of the present invention is to provide a positively chargeable toner for two-component development for stably giving a high-quality fixed image without causing photoconductor contamination even in high-speed copy machines or printers; a positively chargeable two-component developer comprising the positively chargeable toner; and a process for preparing the positively chargeable toner.

These and other objects of the present invention will be apparent from the following description.

SUMMARY OF THE INVENTION

According to the present invention, there are provided:

(1) a positively chargeable toner for two-component development comprising:

a resin binder;

a colorant;

a releasing agent comprising a wax having a melting point of 50° to 120° C.; and an external additive comprising a positively chargeable silica, the positively chargeable silica having an absolute deviation of an error of 0.1 or less, against an approximate straight line showing an adhesion state of silicon atoms to carbon atoms, and a free ratio of 5% or less, wherein the positively chargeable toner is usable together with a ferrite carrier having a saturation magnetization of from 40 to 100 $Am^2/kg$;

(2) a positively chargeable two-component developer, comprising the toner of item (1) above, and a ferrite carrier having a saturation magnetization of from 40 to 100 $Am^2/kg$; and (3) a process for preparing a positively chargeable toner for two-component development, comprising the steps of mixing an untreated toner comprising a resin binder, a colorant, and a releasing agent comprising a wax having a melting point of 50° to 120° C., with an external additive comprising a positively chargeable silica, or a mixture of a positively chargeable silica and a negatively chargeable silica, thereby surface-treating the untreated toner with the external additive; and thereafter sieving the resulting toner, wherein an entire silica in the resulting toner has an absolute deviation of an error of 0.1 or less, against an approximate straight line showing an adhesion state of silicon atoms to carbon atoms, and a free ratio of 5% or less.

DETAILED DESCRIPTION OF THE INVENTION

Figure 1:
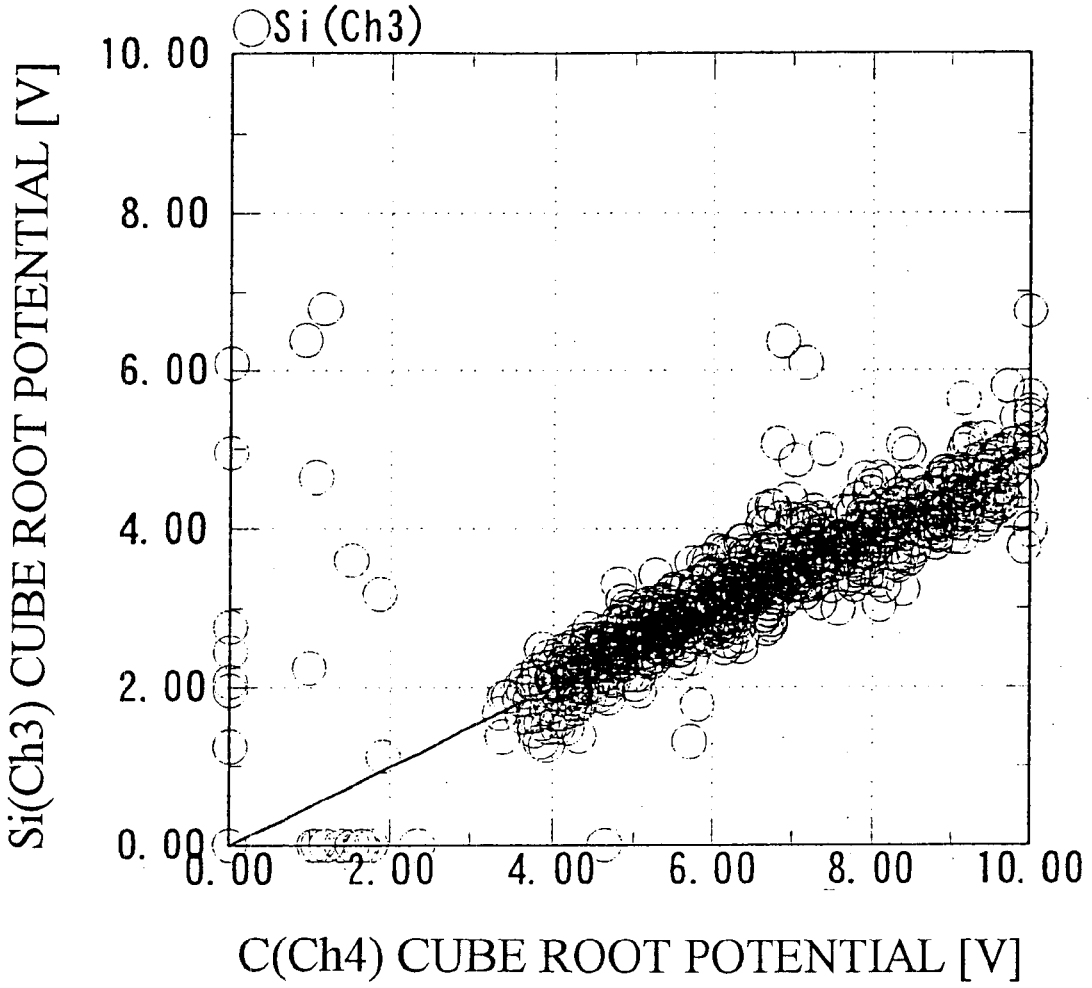
FIG. 1 is a graph showing the results of analysis of the toner L in Examples.

In the present invention, the positively chargeable silica is a silica of which surface is coated with a treating agent having amino group, the silica showing a positive charging upon agitation with iron powder or the like. In general, since a toner contains an externally added positively chargeable silica, in which the positively chargeable silica is treated with a treating agent having amino group, has a high positively chargeability, the toner tends to be electrically bonded to a negatively chargeable carrier. Therefore, when a strong Coulomb force is applied in addition to the agitation force, a positively chargeable silica weakly adhered to a toner, or a positively chargeable silica which is freed from the toner is attracted to the carrier. Therefore, the positively chargeable silica electrically bonded to the carrier is adhered to a photoconductor when a magnetic brush is contacted with the photoconductor. Here, since the force exerted upon the contact of the magnetic brush with the photoconductor depends on the centrifugal force proportional to square of the speed, such a force cannot be neglected especially in a case of high-speed printing at a linear speed of exceeding 370 mm/sec, whereby the photoconductor contamination is generated.

However, since the positively chargeable toner for two-component development of the present invention comprises an external additive comprising a positively chargeable silica having specified absolute deviation and free ratio, the photoconductor contamination can be effectively suppressed.

The absolute deviation shows the adhesion state of the silica to the toner. For instance, the absolute deviation shows the strength and uniformity of adhesion, wherein the smaller the value for the absolute deviation, the silica is more strongly and uniformly adhered. When the silica is non-uniformly and weakly adhered to the toner, the silica is freed when agitating during the triboelectric charging or the like, so that the silica is adhered on a photoconductor via a carrier, thereby causing photoconductor contamination. Therefore, the absolute deviation for the silica is 0.1 or less, preferably 0.09 or less, more preferably 0.08 or less. In order to prevent impairment of the chargeability and the fluidity due to embedment of the silica in the toner, the average deviation is preferably 0.02 or more, more preferably 0.05 or more.

In the present invention, the term "absolute deviation" refers to an absolute deviation of an error against an approximate straight line showing an adhesion state of silicon atoms to carbon atoms, obtained by the steps of:

(1) introducing a toner treated with an external additive comprising a positively chargeable silica in a helium atmospheric microwave induction plasma;
(2) exciting and emitting silicon atoms and carbon atoms; and
(3) determining emission spectrum of silicone atoms and carbon atoms in a developer on the basis of the intensity of the emission determined with the passage of time.

Concrete analysis method will be described in Examples set forth below.

The details of this analysis method is described in The Annual Conference of The Society of Electrophotography of Japan (79th), Papers "Japan Hardcopy 97" "A New Approach for the Additive Material Analysis—The Toner Measurement Using by Particle Analyzer System—," Toshiyuki SUZUKI and Hisao TAKAHARA, sponsored by The Society of Electrophotography of Japan (Jul. 7–9, 1997).

The free ratio shows the existing proportion of silica freed from the toner. The free ratio of the silica is 5% or less, preferably 4% or less, more preferably 3% or less, from the viewpoint of suppressing the photoconductor contamination, and the free ratio is preferably 0.1% or more, more preferably 0.5% or more, from the viewpoint of the fluidity.

The adjustments of the absolute deviation and the free ratio cannot be absolutely determined, because the absolute deviation and the free ratio differ depending upon the facilities for toner preparation, and production scale, and the like. For instance, the adjustments can be made by such a process as making the peripheral speed of the mixer higher in the surface treatment step, making the agitation time longer, or sieving with a sieve having a finer size in the sieving step.

The positively chargeable silica can be contained together with other external additives. It is preferable that the positively chargeable silica is contained in the amount of from 60 to 100% by weight, preferably from 90 to 100% by weight, of the entire external additive.

In the present invention, it is preferable that the positively chargeable silica is a silica subjected to a hydrophobic treatment with an organopolysiloxane having nitrogen atom in its side chain.

The organopolysiloxane having nitrogen atom in its side chain can be obtained by, for instance, substituting one or more side chains of the organopolysiloxane with a group having amino group. The group having amino group includes, a group represented by $—R^1—NH—R^2—N(R^3)_2$, a group represented by $—R^1—N(R^3)_2$, wherein each of $R^1$ and $R^2$ is an alkylene group, preferably an alkylene group having 1 to 10 carbon atoms, more preferably having 1 to 5 carbon atoms, or an arylene group, preferably an arylene group having 6 to 18 total carbon atoms, more preferably phenylene group; and $R^3$ is hydrogen atom or an alkyl group having 1 to 4 carbon atoms, preferably hydrogen atom, and the like.

The organopolysiloxane having nitrogen atom in its side chain has an amino equivalency of 200 or more, from the viewpoint of enhancing an effect of giving positively chargeability, and has an amino equivalency of preferably 22500 or less, from the viewpoint of preventing transfer and adhesion of the positively chargeable silica to the carrier, and has an amino equivalency of more preferably from 300 to 10000.

The organopolysiloxane has a viscosity at 25° C. of preferably from 10 to 10000 mPa·s, more preferably from 20 to 3500 mPa·s.

The method of hydrophobic treatment of the silica by the organopolysiloxane is not particularly limited, as long as the method enables adsorption of the organopolysiloxane to the silica surface. For instance, the method of hydrophobic treatment includes a method comprising spraying a solution prepared by diluting an organopolysiloxane in a solvent to silica in a mixing vessel with agitating, and heating and drying for a given period of time in the vessel with continuously agitating.

In the present invention, the amount of the organopolysiloxane added to the silica is preferably from 1 to 7 $mg/m^2$ per surface area of the silica. The amount of the organopolysiloxane is preferably 1 $mg/m^2$ or more, from the viewpoint of increasing an effect of reducing background fogging, and the amount is preferably 7 $mg/m^2$ or less, from the viewpoint of uniformly adhering the silica to the surface of an untreated toner. The amount of the organopolysiloxane corresponds to 5 to 35 parts by weight, per 100 parts by weight of the silica, in a case of a silica having a BET specific surface area of 50 $m^2/g$.

The hydrophobically treated silica has an average primary particle size of preferably from 5 to 100 nm, more preferably from 10 to 70 nm.

Commercially available positively chargeable silicas which are subjected to hydrophobic treatment with the organopolysiloxane having nitrogen atom in its side chain include "HVK-2150," "HDK H3050VP" (hereinabove commercially available from Clariant (Japan) K.K.), and the like.

The positively chargeable silica has an average primary particle size of preferably from 5 to 100 nm, more preferably from 10 to 70 nm.

The content of the positively chargeable silica is preferably 0.05 parts by weight or more, based on 100 parts by weight of a toner without a treatment with the external additive (untreated toner), from the viewpoints of the chargeability and the fluidity, and the content is preferably 3 parts by weight or less, from the viewpoint of preventing excessive freeing of the silica. Therefore, the content of the positively chargeable silica is preferably from 0.05 to 3 parts by weight, more preferably from 0.1 to 2 parts by weight, especially preferably from 0.2 to 0.9 parts by weight, based on the untreated toner.

It is preferable that a negatively chargeable silica is used together with the positively chargeable silica in the toner of the present invention, from the viewpoints of the fluidity of the toner and the prevention of excessive charging.

It is preferable that the negatively chargeable silica is a silica subjected to hydrophobic treatment with a treating agent such as silicone oil, dimethyldichlorosilane, or hexamethyldisilazane, preferably silicone oil.

Commercially available positively chargeable silicas which are subjected to hydrophobic treatment include "R972" (commercially available from Nippon Aerosil, average particle size: 16 nm, hydrophobically treated with a treatment agent: dimethyldichlorosilane), "TS720" (commercially available from Cabot Corporation, average particle size: 8 nm, hydrophobically treated with a treatment agent: silicone oil), "NAX50" (commercially available from Nippon Aerosil, average particle size: 30 nm, hydrophobically treated with a treatment agent: hexamethyldisilazane), and the like.

The negatively chargeable silica has an average primary particle size of preferably from 5 to 100 nm, more preferably from 10 to 70 nm, especially preferably from 10 to 30 nm.

It is preferable that the weight ratio of the positively chargeable silica to the negatively chargeable silica (positively chargeable silica/negatively chargeable silica) is preferably from 90/10 to 50/50.

When the positively chargeable silica and the negatively chargeable silica are used together, the absolute deviation of the entire silica in the resulting toner is 0.1 or less, preferably 0.09 or less, from the viewpoint of suppressing the photoconductor contamination, and the absolute deviation is preferably 0.02 or more, more preferably 0.05 or more, from the viewpoint of prevention of impairment in the chargeability and the fluidity due to embedment of the silica into the toner. In addition, the entire silica has a free ratio of 5% or less, preferably 4% or less, from the viewpoint of suppressing the photoconductor contamination, and a free ratio of preferably 0.1% or more, more preferably 0.5% or more, from the viewpoint of the fluidity.

The toner of the present invention comprises a resin binder, a colorant and a releasing agent.

The resin binder includes polyesters, styrene-acrylic resins, epoxy resins, polycarbonates, polyurethanes, hybrid resins, and the like. In the present invention, the polyesters and the hybrid resins are preferable, more preferably, the polyesters, from the viewpoints of the low-temperature fixing ability, the durability and the dispersibility of the releasing agent. The polyester has a strong polar group at the terminal group, so that the releasing agent is likely to be bleed out from the toner surface as compared to the styrene-acrylic resin, whereby the polyester is effective for preventing the photoconductor contamination by the reduction of the frictional forces with the photoconductor. The content of the polyester or the hybrid resin is preferably from 50 to 100% by weight, more preferably from 90 to 100% by weight, especially preferably 100% by weight, of the resin binder.

The term "hybrid resin" as referred to herein is a resin in which a condensation polymerization resin component, such as a polyester, is partially chemically bonded with an addition polymerization resin component such as a vinyl resin. The hybrid resin may be obtained by using two or more resins as raw materials, or it may be obtained by using one resin and raw material monomers of the other resin. Further, the hybrid resin may be obtained from a mixture of raw material monomers of two or more resins. In order to efficiently obtain a hybrid resin, those obtained from a mixture of raw material monomers of two or more resins are preferable.

In general, although the polyester and the hybrid resin have excellent durability and fixing ability, it is difficult to adjust the dispersibility of the positively chargeable charge control agent in the polyester or the hybrid resin, so that problems in the chargeability, toner spent, photoconductor contamination and the like are likely to be caused. However, in the present invention, the magnetic brush is soft and appropriate by using together with a ferrite carrier having a low saturation magnetization, whereby the defects in the polyester and the hybrid resin mentioned above can be improved.

The raw material monomer for the polyester in the present invention is not particularly limited, and any of known polyhydric alcohol components and known polycarboxylic acid components such as carboxylic acids, carboxylic acid anhydrides, and esters thereof.

It is preferable that the alcohol component contains a compound represented by the formula (I):

(I)

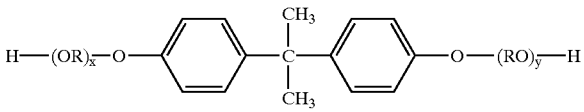

wherein R is an alkylene group having 2 or 3 carbon atoms; each of x and y is a positive number, wherein a sum of x and y is from 1 to 16, preferably from 1.5 to 5.0.

The compound represented by the formula (I) includes alkylene(2 to 3 carbon atoms) oxide(average number of moles: 1 to 16) adduct of bisphenol A such as polyoxypropylene(2.2)-2,2-bis(4-hydroxyphenyl)propane and polyoxyethylene(2.2)-2,2-bis(4-hydroxyphenyl) propane, and the like. In addition, other alcohol component includes ethylene glycol, propylene glycol, glycerol, pentaerythritol, trimethylolpropane, hydrogenated bisphenol A, sorbitol, and alkylene(2 to 4 carbon atoms) oxide(average number of moles: 1 to 16) adducts thereof. These polyhydric alcohol components can be used alone or in admixture of two or more kinds.

It is desired that the content of the compound represented by the formula (I) is 5% by mol or more, preferably 50% by mol or more, more preferably 100% by mol.

In addition, the carboxylic acid component includes dicarboxylic acids such as phthalic acid, isophthalic acid, terephthalic acid, fumaric acid, maleic acid, adipic acid, and succinic acid; a substituted succinic acid of which substituent is an alkyl group having 1 to 20 carbon atoms or an alkenyl group having 2 to 20 carbon atoms, such as dodecenylsuccinic acid and octylsuccinic acid; tricarboxylic or higher polycarboxylic acids such as trimellitic acid and pyromellitic acid; acid anhydrides thereof; alkyl(1 to 8 carbon atoms) esters thereof; and the like. These carboxylic acid components can be used alone or in admixture of two or more kinds.

The polyester can be prepared by, for instance, polycondensation of an alcoholic component with a carboxylic acid component at a temperature of 180° to 250° C. in an inert gas atmosphere in the presence of an esterification catalyst as desired.

The resin binder has an acid value of preferably from 1 to 20 mg KOH/g, more preferably from 2 to 15 mg KOH/g, especially preferably from 3 to 10 mg KOH/g, from the viewpoint of giving a sufficient triboelectric charge as a positively chargeable toner. Also, it is preferable that the resin binder has a hydroxyl value of from 20 to 40 mg KOH/g, a softening point of 110° to 160° C. and a glass transition point of 50° to 70° C.

As the colorants, all of the dyes and pigments which are used as conventional colorants for toners can be used, and the colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazoyellow, and the like. These colorants can be used alone or in admixture of two or more kinds. In addition, the toner may be any of black toners, color toners and full-color toners. The content of the colorant is preferably from 1 to 40 parts by weight, more preferably from 3 to 10 parts by weight, based on 100 parts by weight of the resin binder.

The releasing agent comprises a wax having a melting point of from 50° to 120° C., preferably from 60° to 100° C. (hereinafter referred to as "low-melting point wax"), from the viewpoints of improving the low-temperature fixing ability and improving the fluidity. The preferred low-melting point wax is carnauba wax, rice wax and candelilla wax, more preferably carnauba wax, from the viewpoints of the dispersion (dispersion diameter) of the wax in a resin binder and the low-temperature fixing ability.

Usually, when a silica is firmly adhered to a toner for the purpose of improving the photoconductor contamination, the fluidity of the toner is impaired. However, in the present invention, the releasing agent exists on the toner surface, so that the fluidity would not be impaired even when the silica is firmly adhered to the toner. Since the low-melting point wax especially has low viscosity, a kneading shear cannot be easily applied during the toner preparation, so that the dispersion diameter in the resin binder becomes large. Therefore, the frictional resistance between the toners is efficiently lowered, so that the lowering of the fluidity can be prevented.

As the releasing agent, a high-melting point wax having a melting point exceeding 120° C. can be appropriately used in combination with the low-melting point wax. The content of the low-melting point wax is preferably from 0.1 to 15 parts by weight, more preferably from 0.5 to 10 parts by weight, especially preferably from 1 to 5 parts by weight, based on 100 parts by weight of the resin binder, from the viewpoint of the durability of the toner.

The toner of the present invention may appropriately contain an additive such as an electric conductivity modifier, an extender, a reinforcing filler such as a fibrous substance, an antioxidant, an anti-aging agent, a fluidity improver, and a cleanability improver.

The toner of the present invention can be prepared by a surface treatment step comprising mixing an untreated toner comprising a resin binder, a colorant, and a releasing agent with an external additive comprising a positively chargeable silica, or a mixture of a positively chargeable silica and a negatively chargeable silica. The untreated toner may be any of pulverized toners, polymerization toners, emulsion phase-inversion toners, and the like, and the pulverized toner is preferable. The untreated toner is prepared by, for instance, homogeneously mixing a resin binder, a colorant, a releasing agent and the like in a mixer such as a Henschel mixer or a Super Mixer, thereafter melt-kneading with a closed kneader or a single-screw or twin-screw extruder, cooling, roughly pulverizing the product with a hammer-mill, and further finely pulverizing with a fine pulverizer utilizing a jet stream or a mechanical pulverizer, and classifying the pulverized product with a classifier utilizing rotary stream or a classifier utilizing Coanda effect, to give a toner of a given particle size. The volume-average particle size of the toner is preferably from 3 to 15 μm.

The mixing of the untreated toner with the external additive can be carried out with an agitating apparatus such as a Henschel mixer (commercially available from Mitsui Miike Machinery Co., Ltd.), Super Mixer (commercially available from KAWATA MFG Co., Ltd.), Mechanofusion System (commercially available from Hosokawa Micron), or the like. Among them, the Henschel mixer is preferable from the viewpoint of the agitating force. In addition, when the agitating apparatus is used, in order to sufficiently adhere the external additive to the toner, it is preferable that the peripheral speed of the mixer is increased, or that the agitating time is lengthened.

The silica is usually in a secondary aggregation state. For this reason, when the untreated toner is mixed with non-pulverized silica, the aggregated silica is unevenly adhered to the toner surface, so that photoconductor contamination is likely to be caused. Therefore, it is preferable that at least one, more preferably both, of the positively chargeable silica and the negatively chargeable silica, is a pulverized silica which is previously subjected to pulverization treatment with a mixer or the like.

After the surface treatment step, it is preferable that the untreated toner mixed with the external additive is carefully subjected to sieving step, to give a toner of the present invention. After the sieving step, it is more preferable that the process further comprises an agitating step comprising agitating only the toner in a mixer. Further, after the agitating step, it is especially preferable that the process further comprises a re-sieving step. As described above, by repeating the sieving step and the agitating step, a toner having more uniform and firm adhesion of the silica and having little free silica can be obtained. Specifically, by carrying out a surface treatment step comprising mixing an untreated toner with a silica with agitating, and an agitating step comprising agitating only the toner, the silica adhered to the surface of the toner obtained in the surface treatment step can be more firmly adhered.

In the sieving step, it is preferable to use a fine sieve with a small size (mesh), and those having a sieve-opening of 50 μm or less (300 mesh or more) are preferable. The devices to be used for the sieving step include Sato-type vibration sieve (commercially available from Koei Sangyo Co., Ltd.), Gyro-sifter (commercially available from Tokuju), ultrasonic sieve (commercially available from Russell), and the like, and the ultrasonic sieve is preferable, because foreign particles are less likely to be generated, so that the quality deterioration is less likely to take place.

It is preferable that the operating frequency for the ultrasonic wave when the ultrasonic sieve is used is from 10 to 200 kHz.

The toner of the present invention is used together with a ferrite carrier having a saturation magnetization of from 40 to 100 $Am^2/kg$ (emu/g) as a two-component developer. When the ferrite carrier has a saturation magnetization exceeding 100 $Am^2/kg$, toning and reproduction of intermediate toning are impaired because the magnetic brush comprising the carrier and the toner, on the developer sleeve is hard and tight. On the other hand, when the ferrite carrier has a saturation magnetization of less than 40 $Am^2/kg$, the carrier scattering and carrier adhesion to the photoconductor are caused. Therefore, the carrier has a saturation magnetization of from 40 to 100 $Am^2/kg$, preferably from 45 to 90 $Am^2/kg$, more preferably from 50 to 80 $Am^2/kg$.

In the present invention, the core material for the ferrite carrier includes zinc-based ferrite, nickel-based ferrite, copper-based ferrite, copper-zinc-based ferrite, nickel-zinc-based ferrite, manganese-based ferrite, magnesium-based ferrite, manganese-magnesium-based ferrite, copper-magnesium-based ferrite, manganese-zinc-based ferrite, manganese-copper-zinc-based ferrite, and the like. Among them, manganese-based ferrite, magnesium-based ferrite, manganese-magnesium-based ferrite, each not containing a heavy metal are preferable, from the viewpoints of the environmental pollutions.

The surface of the core material may be coated with a known coating agent such as a fluororesin, a silicone resin, an acrylic resin, a polyester resin, a polyolefin resin, a urethane resin or the like. Among them, the fluororesin and the silicone resin each having low surface energy are preferable. The fluororesin having high electronegativity is more preferable, because the carrier to be used together with the positively chargeable toner is negatively charged.

The fluororesin includes polyvinyl fluoride, polyvinylidene fluoride, polytrifluoroethylene, polytrifluorochloroethylene, polytetrafluoroethylene, perfluoropolymer such as polyperfluoropropylene; vinylidene fluoride-based fluororesins such as copolymer of at least one of acrylic acid, trifluorochloroethylene, vinyl fluoride, tetrafluoroethylene, hexafluoropropylene or the like with vinylidene fluoride.

In the present invention, when the coating agent is a fluororesin, it is preferable that the acrylic resin is further contained in the coating agent, from the viewpoint of increasing the adhesive strength against the core material, thereby improving the durability of the carrier. Here, the acrylic resin is preferably a (co)polymer comprising one or more monomers selected from an alkyl(1 to 18 carbon atoms) ester of (meth)acrylic acid, and styrene derivatives as the main components, more preferably a (co)polymer comprising one or more of styrene, methyl methacrylate and butyl acrylate as the main components, especially preferably a (co)polymer comprising methyl methacrylate as the main component.

It is preferable that the fluororesin is contained in the resin for coating a core material in an amount of 50% by weight or more. When the acrylic resin is further contained, the acrylic resin is contained in an amount of preferably from 25 to 100 parts by weight, more preferably from 40 to 90 parts by weight, especially preferably from 50 to 80 parts by weight, based on 100 parts by weight of the fluororesin.

The core material can be coated with the resin by, for instance, dissolving the resin in an organic solvent or the like, applying the resulting solution to a carrier surface by immersion, spraying or the like, thereafter drying and thermally curing to form a coating film.

The carrier having a volume average particle size of preferably from 50 to 200 $\mu$m, more preferably from 60 to 150 $\mu$m, especially preferably from 70 to 130 $\mu$m.

The positively chargeable two-component developer of the present invention is prepared by mixing a toner and a carrier. The weight ratio of the toner to the carrier (toner/carrier) is preferably from 0.5/100 to 8/100, more preferably from 1/100 to 6/100.

Since the positively chargeable two-component developer of the present invention has excellent durability, prevention of toner spent, and chargeability, the developer can be suitably used for high-speed machines such as high-speed copy machines and high-speed printers, comprising a photoconductor having a linear speed of 370 mm/sec or more, preferably from 500 to 2400 mm/sec.

EXAMPLES

Softening Point

The softening point is determined by a method according to ASTM D36-86.

Acid Value and Hydroxyl Value

The acid value and the hydroxyl value are measured by a method according to JIS K 0070.

Glass Transition Point and Melting Point

A temperature is determined with a sample using a differential scanning calorimeter ("DSC Model 210," commercially available from Seiko Instruments, Inc.), when the sample is treated by raising its temperature to 200° C., allowing the hot sample to stand at the temperature for 3 minutes, cooling the sample at a cooling rate of 10° C./min. to room temperature, and thereafter heating the sample so as to raise the temperature at a rate of 10° C./min. The temperature of an intersection of the extension of the baseline of not more than the endothermic temperature and the tangential line showing the maximum slope between the kickoff of the peak and the top of the peak is referred to as a glass transition point for a resin, and the temperature at top of the peak is referred to as a melting point for a wax.

Absolute Deviation and Free Ratio

The emission spectra of carbon atoms and silicon atoms in a toner treated with an external additive are determined by carrying out 5 cycles, each cycle comprising the conditions described below as 1 cycle, using a microparticle analyzer "Particle Analyzer PT 1000" (commercially available from YOKOGAWA ELECTRIC CORPORATION), with carbon atoms and silicon atoms as the atoms to be analyzed. In addition, "Toner Analysis Software, version 2.00" (commercially available from YOKOGAWA ELECTRIC CORPORATION) is used as a software for spectrum data analysis. The distribution graph of carbon atom potential and silicon atom potential (the cube root potential of carbon atoms is plotted along x-axis and the cube root potential of silicon atoms is plotted along y-axis) is obtained from the synchronous emission spectrum data, and an approximate straight line is obtained by the least-squares method. The slope of the approximate straight line and the absolute deviation to the approximate straight line are determined by calculating the deviation of the error value (d/H) obtained from the length (d) of the perpendicular drawn from the determination point to the approximate straight line and the length (H) of the perpendicular drawn from the intersection of the approximate straight line and the perpendicular to x-axis using the above software. In addition, based on the potential obtained from the non-synchronous emission spectrum data of silicon atoms and the potential obtained from the emission spectrum data of total silicon atoms, the free ratio of an external additive (expressed in "% on a number basis" in the Table) is calculated by the above software in accordance with the following equation:

$$\text{Free Ratio of External Additive} = \frac{\text{Count Number of Silicon Atoms Not Simultaneously Emitted with Carbon Atoms}}{\text{Count Number of Silicon Atoms Simultaneously Emitted with Carbon Atoms} + \text{Count Number of Silicon Atoms Not Simultaneously Emitted with Carbon Atoms}} \times 100$$

The conditions for microparticle analysis are as follows:

Count number of carbon atoms per scan: 500 to 1500

Number of scanning: 8

Toner aspirating apparatus: Low-Volume Sampler "LV 1000" commercially available from YOKOGAWA ELECTRIC CORPORATION Chip for aspirating the toner: a chip commercially available from Eppendorf Co., Ltd. (Grade "100 μl")

Tube for aspirating the toner: Taigon Tube "R-3603" commercially available from Norton (inner diameter of the tube ϕ: 6.35 mm, length: 50 mm)

Filter: a filter commercially available from Corning "Nuclepore Membrane Filter" (0.4 μm)

Saturation Magnetization of Carrier (1) A carrier is filled in a plastic case with a lid with tapping, the case having an external diameter of 7 mm and a height of 5 mm. The mass of the carrier is determined from the difference of the weight of the plastic case and the weight of the plastic case filled with the carrier.

(2) The plastic case filled with the carrier is set in a sample holder of a magnetization measuring device "BHV-50H" (V. S. MAGNETOMETER) commercially available from Riken Denshi Co., Ltd. The saturation magnetization is determined by applying a magnetic field of 79.6 kA/m (+1 kOe), with vibrating the plastic case using the vibration function. The value obtained is calculated as saturation magnetization per unit mass, taking into consideration the mass of the filled carrier.

Preparation Example 1 of Resin

Seven-hundred and thirty five grams of polyoxypropylene (2.2)-2,2-bis(4-hydroxyphenyl)propane, 293 g of polyoxyethylene(2.2)-2,2-bis(4-hydroxyphenyl)propane, 280 g of isophthalic acid, 60 g of isooctenylsuccinic acid, 72 g of trimellitic acid and 2 g of dibutyltin oxide (esterification catalyst) were reacted at 230° C. in vacuo under a nitrogen gas atmosphere, with stirring, until the softening point reached 136° C., to give a resin A. The resin A was a pale yellow solid having an acid value of 3.1 mg KOH/g, a hydroxyl value of 35.2 mg KOH/g and a glass transition point of 63° C.

Preparation Example 2 of Resin

To 550 g of xylene were added dropwise a mixture of 800 g of styrene, 300 g of n-butyl acrylate, and 26 g of dicumyl peroxide as a polymerization initiator under a nitrogen gas atmosphere at 135° C. over 1 hour, and the mixture was further aged for 2 hours. Thereafter, xylene was removed under reduced pressure, to give a resin B. The resin had a softening point of 138° C., and a glass transition point as determined by DSC (differential scanning calorimeter) of 65° C.

Preparation Example of Untreated Toner a

One-hundred parts by weight of the resin A, 6 parts by weight of a carbon black "R330R" (commercially available from Cabot Corporation), 1 part by weight of a polypropylene wax "NP-055" (commercially available from Mitsui Chemicals Inc., melting point: 142° C.), 1.5 parts by weight of "Carnauba Wax No. 1" (commercially available from K.K. Kato Yoko, melting point: 83° C.) and 1.5 parts by weight of a charge control agent "BONTRON N-01" (commercially available from Orient Chemical Co., Ltd.) were mixed together with a Henschel Mixer. Thereafter, the mixture was melt-kneaded with a twin-screw kneader, cooled, pulverized and classified, to give an untreated toner a having a volume-average particle size of 10 μm.

Preparation Example of Untreated Toner b

The same procedures were carried out as in the case of the untreated toner a except that "Carnauba Wax No. 1" was not used, to give an untreated toner b.

Preparation Example of Untreated Toner c

The same procedures were carried out as in the case of the untreated toner a except that 100 parts by weight of the resin B were used in place of the resin A, to give an untreated toner c.

Preparation Example of Toners A to M

Using 100 parts by weight of an untreated toner and 0.5 parts by weight of an external additive as shown in Table 1, a process comprising:

Step 1: mixing the untreated toner and the external additive;

Step 2: sieving the toner mixed with the external additive;

Step 3: agitating only the toner passing through the sieve in the step 2; and

Step 4: re-sieving the agitated toner was carried out as prescribed in Table 1, to give a toner. The absolute deviation and the free ratio of the resulting toner are shown in Table 1. Incidentally, in the preparation of the toners D and E, a mixture was agitated with a Henschel Mixer (commercially available from Mitsui Miike Machinery Co., Ltd.) at 70 r/min for 10 minutes, and a pulverized external additive was used.

The results of analysis for the toner L are shown in FIG. 1. In this analysis, the synchronization count number of carbon and silicon atoms was 2909, the non-synchronization count number of silicon atoms was 27, the non-synchronization count number of carbon atoms was 23, the free ratio of silicon atoms was 0.92%, and the free ratio of carbon atoms was 0.78%. In addition, the slope of the straight line calculated based on the cube root potentials was 0.501, and the absolute deviation was 0.064.

TABLE 1

| | Untreated Toner | External Additive | Step 1 (Surface Treatment Step) Mixing Time (min) | Step 1 (Surface Treatment Step) Peripheral Speed (r/min) | Step 2 (Sieving Step) Sieve | Step 2 (Sieving Step) Mesh | Step 3 (Agitating Step) Mixing Time (min) | Step 3 (Agitating Step) Peripheral Speed (r/min) | Step 4 (Re-sieving Step) Sieve | Absolute Deviation | Free Ratio (%) |
|---|---|---|---|---|---|---|---|---|---|---|---|
| Toner A | a | RA200H | 10 | 50 | Ultrasonic Sieve | 330 | — | — | — | 0.09 | 4.2 |
| Toner B | a | HVK-2150 | 10 | 50 | Ultrasonic Sieve | 330 | — | — | — | 0.08 | 3.5 |
| Toner C | c | HVK-2150 | 10 | 50 | Ultrasonic Sieve | 330 | — | — | — | 0.08 | 3.3 |
| Toner D | a | HVK-2150 | 10 | 70 | Ultrasonic Sieve | 330 | — | — | — | 0.08 | 2.1 |
| Toner E | a | HVK-2150 | 15 | 50 | Ultrasonic Sieve | 330 | 10 | 70 | Ultrasonic Sieve | 0.06 | 1.4 |
| Toner F | a | HVK-2150 | 5 | 50 | Vibrating Sieve | 150 | — | — | — | 0.37 | 32.4 |
| Toner G | a | RA200H | 10 | 50 | Ultrasonic Sieve | 150 | — | — | — | 0.16 | 28.2 |
| Toner H | a | HVK-2150 | 1 | 50 | Ultrasonic Sieve | 330 | — | — | — | 0.28 | 11.7 |
| Toner I | a | HVK-2150 | 10 | 30 | Ultrasonic Sieve | 330 | — | — | — | 0.31 | 16.8 |
| Toner J | b | HVK-2150 | 10 | 50 | Ultrasonic Sieve | 330 | — | — | — | 0.08 | 3.5 |
| Toner K | a | HVK-2150/0.4 R-972/0.1 | 10 | 50 | Ultrasonic Sieve | 330 | — | — | — | 0.09 | 1.8 |
| Toner L | a | HVK-2150 | 15 | 50 | Ultrasonic Sieve | 400 | 15 | 70 | Ultrasonic Sieve | 0.06 | 0.9 |
| Toner M | a | HVK-2150 | 30 | 70 | Ultrasonic Sieve | 330 | 30 | 70 | Ultrasonic Sieve | 0.01 | 1.1 |

Note)
RA200H: Positively chargeable silica, commercially available from Nippon Aerosil; treating agent: hexamethyldisilazane and aminosilane
HVK-2150: Positively chargeable silica, commercially available from Clariant (Japan) K.K.; treating agent: amino-based polysiloxane
R-972: Negatively chargeable silica, commercially available from Nippon Aerosil; treating agent: dimethyldichrolosilane
Surface Treatment Step and Re-agitating Step: Henschel Mixer (commercially available from Mitsui Miike Machinery Co., Ltd.)
Sieving Step and Re-sieving Step:
Ultrasonic sieve: (commercially available from Russell; frequency: 50 kHz; amplitude: 1 $\mu$m)
Vibrating sieve: (Sato-type vibrating sieve, commercially available from Koei Sangyo Co., Ltd.)
330-mesh: sieve opening 45 $\mu$m, 150-mesh: sieve opening 105 $\mu$m

Preparation Example 1 of Carrier

Magnesium oxide (MgO) was formulated with hematite so as to have a content of magnesium of 3.0% by weight. To 100 parts by weight of the resulting mixture were added 1.5 parts by weight of a binder (polyvinyl alcohol) and 0.5 parts by weight of a dispersant, and water was added so as to have a slurry concentration of 50% by weight. The ingredients were mixed with wet-pulverization for 1 hour with an attritor commercially available from MITSUI MINING & SMELTING CO., LTD., to prepare a slurry.

The slurry was granulated and dried with a spray-drier, and then sintered at about 1500° C. in an electric oven under nitrogen gas atmosphere, and the sintered product was classified with a vibrating sieve, to give magnesium ferrite represented by $MgO.Fe_2O_3.Fe_3O_4$ as a core material of a carrier.

To 6.5 parts by weight of a vinylidene fluoride-based fluororesin "HYLAR 301 F" (commercially available from Ausmond), and 3.5 parts by weight of a methyl methacrylate resin "Dianal BR-80" (commercially available from Mitsubishi Rayon Co., Ltd.), based on 1000 parts by weight of the resulting core material, 100 parts by weight of methyl ethyl ketone were added, to prepare a resin solution for coating the core material. This resin solution was spray-coated on the core material using a fluidized-coating device. Thereafter, a heat treatment was carried out at 100° C. for 60 minutes in the fluidized bed, to give a carrier A having a volume-average particle size of 110 $\mu$m. The saturation magnetization of the carrier A was 52.5 $Am^2/kg$.

Preparation Example 2 of Carrier

The same procedures were carried out as in Preparation Example 1 of Carrier except that magnesium oxide (MgO) and manganese oxide (MnO) were formulated with hematite so as to have a content of magnesium of 7.0% by weight and a content of manganese of 20.0% by weight, to give a carrier B. The saturation magnetization of the carrier B was 60.9 $Am^2/kg$.

Preparation Example 3 of Carrier

The same procedures were carried out as in Example 1 except that an iron powder carrier was used as a core material, and the surface of the core material was coated with a resin, to give a carrier C. The saturation magnetization of the carrier C was 165.2 $Am^2/kg$.

Preparation Example 4 of Carrier

The same procedures were carried out as in Preparation Example 1 of Carrier except that manganese oxide (MnO), copper oxide (CuO) and zinc oxide (ZnO) were formulated with hematite so as to have a content of manganese of 7.0% by weight, a content of copper of 0.5% by weight and a content of zinc of 0.5% by weight, to give a core material for a carrier. To 1000 parts by weight of the resulting core material, 100 parts by weight of a silicone resin solution "KR 250" (commercially available from Shin-Etsu Silicone Co., Ltd.) and 100 parts by weight of toluene were added, to prepare a resin solution for coating the core material. This resin solution was spray-coated on the core material using a fluidized-coating device. Thereafter, a heat treatment was carried out at 200° C. for 120 minutes in the fluidized bed, to give a carrier D having a volume-average particle size of 110 μm. The saturation magnetization of the carrier D was 91.1 $Am^2/kg$.

Examples 1 to 10 and Comparative Examples 1 to 6

Thirty-nine parts by weight of a toner and 1261 parts by weight of a carrier as shown in Table 2 were mixed with a Nauta Mixer, to give each developer.

A developer was loaded in a contact development device "Infoprint 4000 IS1" (commercially available from IBM Japan, Ltd., linear speed: 1066 mm/sec, resolution: 240 dpi, development system: 3 magnet rollers and selenium photoconductor, reversal development). A 1000000-sheet continuous printing was carried out using a continuous feeding paper with 11×18 inches. During the continuous printing, printing was carried out such that a printing pattern had 10% blackened ratio for the first 50000 sheets, that a printing pattern had 20% blackened ratio for the 50001st sheet to the 500000th sheet, and that a printing pattern had 30% blackened ratio for the 500001st sheet to the 1000000th sheet. The triboelectric charges after printing 50000, 500000 or 1000000 sheets and the maximum change in the triboelectric charges were determined. Thereafter, the image quality of solid image, the background fogging and the photoconductor contamination were observed based on the images of the first 1000 printouts. The results are shown in Table 2.

Triboelectric Charges

The triboelectric charges are measured using a Q/M meter (commercially available from Epping GmbH). A specified amount of a developer is supplied in a cell provided in the Q/M meter, and only toner is aspirated for 90 seconds through a sieve having a sieve opening of 32 μm (made of stainless steel, twilled, wire diameter: 0.0035 mm). The voltage change generated on the carrier at this time is monitored, and the value of [Total Triboelectric Charges After 90 Seconds (μC)/Amount of Toner Aspirated (g)] after printing 50000, 500000 or 1000000 sheets are determined as the triboelectric charges (μC/g).

Maximum Change of Triboelectric Charges

The maximum difference (maximum change) between the triboelectric charges after printing 50000, 500000 or 1000000 sheets and the initial triboelectric charges is determined, and evaluated according to the following evaluation criteria:

Evaluation Criteria

◎: The maximum change is less than 1.0 μC/g, which is excellent.

○: The maximum change is 1.0 μC/g or more and less than 2.0 μC/g, which is good.

Δ: The maximum change is 2.0 μC/g or more and 3.0 μC/g or less, which has no problem for practical purposes.

X: The maximum change is more than 3.0 μC/g, which is not useful in practical purposes.

Image Quality of Solid Image

A black solid image part of a printout is determined using a "Model 938 Spectrodensitometer" (commercially available from X-Rite, aperture: 20 mm, determination mode: Yxy, light source: $D_{65}$, angle of scope: 10 degree). The image density was calculated in accordance with the following equation:

$$\text{Image Density} = \log(1/Y)$$

A part where density unevenness, white spot or black core is found is visually observed. The image quality was evaluated according to the following evaluation criteria:

Evaluation Criteria

◎: The image quality is even and the image density is optimum (1.18 to 1.22), which is excellent.

○: The image quality is even and the image density is within the appropriate range (1.15 to 1.25), which is good.

Δ: The density unevenness is found, but it is no problem for practical purposes.

X: White spot or black core is found, which is not useful for practical purposes.

Background Fogging

Y values of a white part of a printout and a paper before printing are determined using a "Model 938 Spectrodensitometer" (commercially available from X-Rite, aperture: 20 mm, determination mode: Yxy, light source: $D_{65}$, angle of scope: 10 degree). The background fogging was calculated in accordance with the following equation:

$$\text{Background Fogging} = Y \text{ value of Paper Before Printing} - Y \text{ value of White Part of Printout}$$

The background fogging was evaluated in accordance with the following evaluation criteria:

Evaluation Criteria

◎: The background fogging is less than 0.4, which is excellent.

○: The background fogging is 0.4 or more and less than 1.0, which is good.

Δ: The background fogging is 0.8 or more and less than 1.2, which is no problem for practical purposes.

X: The background fogging is 1.2 or more, which is not useful for practical purposes.

Photoconductor Contamination

The number of the printing sheets in which a white spot is generated in the black solid image part in the printout as a consequence of generation of damage on the photoconductor resulting from the stress by the developer, or toner filming is referred to as the number of photoconductor contamination-generated sheets. In the table, "filming" or "damage" is also shown, and whether the photoconductor contamination results from "filming" or "damage". The judgment is made as follows. The case where the contamination can be removed by wiping the photoconductor with an ethanol-dipped waste cloth is referred to as "filming", and the case where the contamination cannot be removed is referred to as "damage."

TABLE 2

| | | | Triboelectric Charges (μC/g) | | | | Image Quality of Solid Image | | | | Photoconductor |
|---|---|---|---|---|---|---|---|---|---|---|---|
| | Toner | Carrier | 50000 sheets | 500000 sheets | 1000000 sheets | Maximum Change | 50000 sheets | 500000 sheets | 1000000 sheets | Background Fogging | Contamination (× 1000 sheets) |
| Ex. No. | | | | | | | | | | | |
| 1 | A | A | 21.4 | 22.8 | 22.1 | ○ | ○ | ○ | ○ | ○ | None |
| 2 | B | A | 21.7 | 19.9 | 20.5 | ○ | ○ | ○ | ○ | ○ | None |
| 3 | B | B | 20.2 | 22.4 | 21.9 | ○ | ◎ | ○ | ○ | ○ | None |
| 4 | C | A | 21.9 | 21.2 | 21.5 | ◎ | ○ | Δ | Δ | Δ | None |
| 5 | D | A | 21.2 | 21.9 | 21.4 | ◎ | ◎ | ◎ | ○ | ◎ | None |
| 6 | E | A | 21.0 | 21.2 | 20.8 | ◎ | ◎ | ◎ | ◎ | ◎ | None |
| 7 | A | D | 21.9 | 20.2 | 22.5 | Δ | ○ | ○ | Δ | Δ | None |
| 8 | K | A | 20.8 | 21.4 | 21.2 | ◎ | ◎ | ○ | ○ | ◎ | None |
| 9 | L | A | 21.7 | 22.1 | 22.3 | ◎ | ◎ | ◎ | ◎ | ◎ | None |
| 10 | M | A | 19.7 | 18.4 | 17.6 | Δ | ○ | Δ | Δ | ○ | None |
| Comp. Ex. No. | | | | | | | | | | | |
| 1 | F | A | 21.6 | 15.9 | — | × | Δ | × | — | × | 410/Filming |
| 2 | G | A | 19.8 | 17.5 | 14.3 | × | ○ | × | × | Δ | 547/Filming |
| 3 | H | A | 21.4 | 25.7 | 28.6 | × | ○ | Δ | × | × | 638/Filming |
| 4 | I | A | 19.8 | 29.3 | — | × | Δ | × | — | Δ | 325/Filming |
| 5 | J | A | 20.6 | 18.1 | 15.8 | × | Δ | Δ | × | × | None |
| 6 | A | C | 18.2 | 14.0 | — | × | Δ | Δ | × | × | 420/Damage |

In Examples 1 to 10, it is clear that the triboelectric charges are stable, and that the image quality of solid image is excellent, so that there is no problem with all of photoconductor contamination, background fogging and filming.

In Comparative Examples 1 to 4, it is clear that the value of the absolute deviation of silica in the toner is high, and that silica is adhered unevenly and weakly, so that there is a large number of free silica. Therefore, in the continuous printing, the triboelectric charges are decreased due to the detachment of silica, and filming of the toner is generated due to the detached silica.

In Comparative Example 5, since a low melting wax is not added, the flowability is deteriorated. Therefore, the image quality is deteriorated due to the decrease in the triboelectric charges.

In Comparative Example 6, since a magnetite carrier is used as carrier, the image quality is poor as compared with the case where ferrite is used. In addition, since the magnetic brush is strongly contacted, damage is generated on the photoconductor, though filming is not generated.

According to the present invention, there can be provided a positively chargeable toner for two-component development for stably giving a high-quality image without photoconductor contamination even in a high-speed copying machine or printer; a positively chargeable two-component developer comprising the positively chargeable toner; and a process for preparing the positively chargeable toner.

What is claimed is:

1. A positively chargeable toner for two-component development comprising:

a resin binder;

a colorant;

a releasing agent comprising a wax having a melting point of 50° to 120° C.; and an external additive comprising a positively chargeable silica, the positively chargeable silica having an absolute deviation of an error of 0.1 or less, against an approximate straight line showing an adhesion state of silicon atoms to carbon atoms, and a free ratio of 5% or less, wherein the positively chargeable toner is usable together with a ferrite carrier having a saturation magnetization of from 40 to 100 $Am^2/kg$.

2. The positively chargeable toner according to claim 1, which is used in a high-speed printer comprising a photoconductor having a linear speed of 370 mm/sec or more.

3. The positively chargeable toner according to claim 1, further comprising a negatively chargeable silica, wherein an entire silica consisting of the positively chargeable silica and the negatively chargeable silica has an absolute deviation of an error of 0.1 or less, against an approximate straight line showing an adhesion state of silicon atoms to carbon atoms, and a free ratio of 5% or less.

4. The positively chargeable toner according to claim 1, wherein the positively chargeable silica is coated on its surface with a treating agent having amino group.

5. The positively chargeable toner according to claim 1, wherein the content of the positively chargeable silica is from 0.05 to 3 parts by weight, based on 100 parts by weight of a toner without treatment with the external additive.

6. The positively chargeable toner according to claim 1, wherein the positively chargeable silica is prepared by subjecting a silica to a hydrophobic treatment with an organopolysiloxane having nitrogen atom in its side chain.

7. The positively chargeable toner according to claim 6, wherein the organopolysiloxane is added to silica in an amount of 1 to 7 $mg/m^2$ per surface area of the silica.

8. The positively chargeable toner according to claim 1, wherein the average primary particle size of the positively chargeable silica is from 5 to 100 nm.

9. The positively chargeable toner according to claim 1, wherein the resin binder comprises a polyester.

10. The positively chargeable toner according to claim 9, wherein the polyester is a resin obtainable by polycondensing an alcohol component containing 5% by mol or more of a compound represented by the formula (I):

(I)

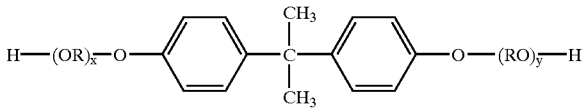

wherein R is an alkylene group having 2 or 3 carbon atoms; each of x and y is a positive number, wherein a sum of x and y is 1 to 16, with a carboxylic acid component.

11. The positively chargeable toner according to claim 1, wherein the releasing agent is at least one wax selected from the group consisting of carnauba wax, rice wax and candelilla wax.

12. A positively chargeable two-component developer, comprising the toner of claim 1, and a ferrite carrier having a saturation magnetization of from 40 to 100 $Am^2/kg$.

13. The positively chargeable two-component developer according to claim 12, wherein the carrier comprises a core comprising a manganese-based ferrite, a magnesium-based ferrite, or a manganese-magnesium-based ferrite, each not containing a heavy metal.

14. A process for preparing a positively chargeable toner for two-component development, comprising the steps of mixing an untreated toner comprising a resin binder, a colorant, and a releasing agent comprising a wax having a melting point of 50° to 120° C., with an external additive comprising a positively chargeable silica, or a mixture of a positively chargeable silica and a negatively chargeable silica, thereby surface-treating the untreated toner with the external additive; and thereafter sieving the resulting toner, wherein an entire silica in the resulting toner has an absolute deviation of an error of 0.1 or less, against an approximate straight line showing an adhesion state of silicon atoms to carbon atoms, and a free ratio of 5% or less.

15. The process according to claim 14, subsequent to the sieving step, further comprising agitating the resulting toner.

16. The process according to claim 14, wherein at least one of the positively chargeable silica and the negatively chargeable silica is a pulverized silica.

* * * * *